US007699187B2

(12) United States Patent
Korsgaard

(10) Patent No.: US 7,699,187 B2
(45) Date of Patent: Apr. 20, 2010

(54) END FITTING FOR PRESSURE VESSEL

(76) Inventor: Jens Korsgaard, 387 Blanketflower La., Princeton Junction, NJ (US) 08550

( * ) Notice: Subject to any disclaimer, the term of this patent is extended or adjusted under 35 U.S.C. 154(b) by 0 days.

(21) Appl. No.: 12/322,824

(22) Filed: Feb. 6, 2009

(65) Prior Publication Data

US 2009/0200317 A1 Aug. 13, 2009

Related U.S. Application Data

(60) Provisional application No. 61/065,197, filed on Feb. 8, 2008.

(51) Int. Cl.
*F17C 1/00* (2006.01)

(52) U.S. Cl. ..... 220/581

(58) Field of Classification Search ..... 220/583, 220/582, 581, 566, 565, 241, 254.2, 254.1, 220/294, 293, 323, 315, 302, 301, 300, 298, 220/367.1, 373, 790, 789, 787, 784, 359.1, 220/678, 677, 309.1, 309.2, 310.1, 610, 611, 220/612, 614, 615, 623; 206/0.6; D9/443, D9/435

See application file for complete search history.

(56) References Cited

U.S. PATENT DOCUMENTS 696,983 A * 4/1902 Logan ..... 220/583
864,884 A * 9/1907 Capaldi ..... 210/463
1,578,194 A * 3/1926 Edelman ..... 220/260
1,818,581 A * 8/1931 Reid ..... 220/302
1,846,506 A * 2/1932 Wiggins ..... 220/565
1,870,904 A * 8/1932 Giesler ..... 92/34
2,238,238 A * 4/1941 Westrope ..... 24/293
2,636,640 A * 4/1953 Bedford, Jr. ..... 220/782
2,753,088 A * 7/1956 Prahl, Jr. ..... 222/215
3,009,602 A * 11/1961 Raehs ..... 220/611
3,050,210 A * 8/1962 Shang ..... 220/566
3,352,443 A * 11/1967 Sattelberg et al. ..... 220/560.12
3,537,938 A * 11/1970 Clements ..... 156/446
4,091,962 A * 5/1978 van Buren, Jr. ..... 220/326
4,307,818 A * 12/1981 Singh et al. ..... 220/316
4,309,493 A * 1/1982 Kuhl et al. ..... 429/172
4,318,491 A * 3/1982 Nelson et al. ..... 220/566

(Continued)

FOREIGN PATENT DOCUMENTS

JP 10148490 A * 6/1998

(Continued)

*Primary Examiner*—Anthony Stashick
*Assistant Examiner*—Robert J Hicks
(74) *Attorney, Agent, or Firm*—Steven Horowitz

(57) ABSTRACT

An end fitting for a cylindrical high pressure vessel made from components all having thin walls, thereby tripling the practical diameter of such pressure vessels. The end fitting includes a toroidal shell defining a hole; centrally disposed piece for closing the hole comprising a pipe and a center end fitting and structural members. In a first embodiment, the structural members comprise slices of an end of the pipe welded to the outer cylindrical wall of the vessel. In a second embodiment, the structural members are plates connecting the pipe to the outer cylindrical walls. In the third embodiment, the plates connect an extension of the outer cylindrical wall beyond the toroidal shell to an extension of the outer cylindrical wall of the pressure vessel. The center end fitting may be hemispheric or ellipsoidal.

35 Claims, 3 Drawing Sheets

U.S. PATENT DOCUMENTS

| | | | | | |
|---|---|---|---|---|---|
| 4,467,936 | A | * | 8/1984 | Makhijani | 220/246 |
| 4,790,472 | A | * | 12/1988 | Bunkoczy | 228/171 |
| 5,765,714 | A | * | 6/1998 | Nakano et al. | 220/619 |
| 5,938,067 | A | * | 8/1999 | Diamond et al. | 220/619 |

FOREIGN PATENT DOCUMENTS

| | | | | |
|---|---|---|---|---|
| JP | 11091843 | A | * | 4/1999 |
| SU | 821108 | B | * | 4/1981 |

* cited by examiner

SECTION 30 - 30

SECTION 45 - 45

SECTION 55 - 55

END FITTING FOR PRESSURE VESSEL

The present invention claims priority to U.S. provisional patent application No. 61/065,197 filed Feb. 8, 2008 by Applicant Jens Korsgaard.

BACKGROUND OF THE INVENTION

The present invention generally relates to apparatus and methods for end fittings for pressure vessels.

A cylindrical pressure vessel has a hoop stress that is twice the longitudinal stress. Therefore a number of technologies exist for reinforcing pressure vessels by strengthening them in the hoop direction by the application of wires wound helically onto the cylindrical pressure vessel or by applying plastic reinforced by fibers in the hoop direction. By these technologies a pressure vessel is obtained that has a lower weight.

End fittings are usually comprised of hemispherical caps or ellipsoidal caps. The end fittings may also be reinforced by the material reinforcing the cylindrical pressure vessel in the hoop direction. The application of the reinforcing to the end fitting presents special problems in terms of applying the reinforcing in the proper geometry and quality. The application of the reinforcing to the end fitting is a difficult and expensive process.

Many reinforced cylindrical pressure vessels are therefore fitted with unreinforced end fittings. When the pressures are high and the diameter of the cylindrical pressure vessel is large the material thickness of the hemispherical caps or ellipsoidal caps becomes large and the cap is difficult and expensive to manufacture.

An example of such a pressure vessel is the tank marketed by the Floating Pipeline Company of Newfoundland Canada. This tank is designed to hold compressed natural gas at a pressure of approximately 23 MPa. It is 915 mm in diameter, made from steel and reinforced by glass reinforced plastic in the hoop direction. The steel wall thickness is approximately 35 mm permitting a hemispherical end fitting made from the same steel with the same wall thickness to safely contain the pressure without being reinforced.

FIG. 1 shows a sectional view, in a plane containing the rotational axis of symmetry, of a prior art cylindrical pressure vessel 6 comprised of a metal cylinder 1 reinforced on the outside by a layer of reinforcement 2 which may be glass-reinforced plastic. The pressure vessel is fitted with a hemispherical end fitting 4 made from the same material as used for the cylinder 1. The end fitting 4 also has the same wall thickness as the cylinder 1. The reinforcement layer 2 reinforces the pressure vessel 6 in the hoop direction only. If the reinforcement layer 2 resists 50% of the internal pressure in pressure vessel 6 then the metal cylinder 1 will have equal hoop and longitudinal stresses, which in turn will be equal to the tensile stresses in the hemispherical end cap 4. The reinforcement layer 2 may be wound onto a cylindrical extension 3 to the pressure vessel 6 in order to ensure that a weak point does not develop at the weld seam 5 between end cap 4 and cylinder 1.

Current rules governing the storage of natural gas in pressure vessels require a shut-off valve and a safety device for each individual tank or pressure vessel. If a 36 inch or 40 inch diameter pressure vessel is used, only one shut-off valve and one safety device may be needed. If, for example, one wanted to store nine times as much natural gas as that stored in a pressure vessel with a 36 inch diameter pressure vessel, one would need nine tanks, each with a safety device and a shut-off valve. A single pressure vessel having a diameter of 108 inches would be able to store nine times the natural gas stored in a single 36 inch diameter and such a tank would only require a single shut-off valve and a single safety device under current rules. Although it would be advantageous to use the much larger diameters in tanks that store natural gas under high pressure in order to reduce the number of tank connections with associated safety devices and valves, practical and cost limitations prevent this. For example, it is exceedingly expensive to make an end cap that is 108 inches in diameter. In fact, not that many places in the world can even manufacture such an end cap since it requires specialized heavy equipment and special handling.

The difficulty of using thicker material for the end cap of a pressure vessel is further illustrated by reference to another class of cylindrical pressure vessels, which are reinforced on the exterior by high strength steel wires. These wires may be laid with a lay angle such that they also reinforce the tank in the longitudinal direction. Such tanks may have a particularly thin steel wall. This in turn creates a problem of stress continuity at a conventional end fitting having a much thicker wall.

As can be seen, there is a need for a cost effective and practical apparatus and method for a large diameter high pressure vessel, particularly one that is generally cylindrical.

SUMMARY OF THE PRESENT INVENTION

In one aspect of the present invention, there is presented an end fitting for a cylindrical pressure vessel, the pressure vessel having an outer cylindrical wall, the end fitting comprising a toroidal shell defining a hole; a centrally disposed piece comprising a pipe and a center end fitting, the centrally disposed piece closing the hole; and structural members that connect either the centrally disposed piece and/or the toroidal shell to the outer cylindrical wall or to an extension of the outer cylindrical wall.

In a further aspect of the invention, there is presented an end fitting for a cylindrical pressure vessel, the pressure vessel having an outer cylindrical wall, the end fitting comprising a toroidal shell including a central rim that defines a hole inward of the central rim; a centrally disposed piece closing the hole; and a series of internal structural members extending from the toroidal shell and/or from the centrally disposed piece to the outer cylindrical wall.

In a still further aspect of the present invention, there is presented an end fitting for a cylindrical pressure vessel, the pressure vessel having an outer cylindrical wall, the end fitting comprising a toroidal shell including a central rim that defines a hole inward of the central rim; a centrally disposed piece closing the hole, the centrally disposed piece comprising a pipe and a center end fitting; and a series of plates connecting the pipe to the outer cylindrical wall.

In a still further aspect of the present invention, there is presented an end fitting for a cylindrical pressure vessel, the pressure vessel having an outer cylindrical wall, the end fitting comprising a toroidal shell defining a hole; an extension of the outer cylindrical wall beyond the toroidal shell; a centrally disposed piece comprising a pipe and a center end fitting, the centrally disposed piece closing the hole; and a series of plates connecting the centrally disposed piece and the extension of the outer cylindrical wall.

In a still further aspect of the present invention, there is presented a pressure vessel, comprising a generally cylindrical metal container, a first end cap; and a second end cap, at least one of the first and second end caps comprising a toroidal shell defining a hole; a centrally disposed piece closing the hole and comprising a pipe and a center end fitting; and structural members that connect the toroidal shell and/or the centrally disposed piece to either the outer cylindrical wall or to an extension of the outer cylindrical wall.

These and other features, aspects and advantages of the present invention will become better understood with reference to the following drawings, descriptions and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention generally provides a thin walled end fitting to metal pressure vessels that may be used to store natural gas or other gasses under high pressure. High pressure refers to pressure ranges from 8 to 25 MPa and above, for example up to 40 Mpa. The pressure vessel may be reinforced on the exterior, for example by glass fiber, carbon fiber reinforced plastic, or high strength metal wires. The present invention may provide an end fitting to a thin walled metal cylindrical pressure vessel that may allow the pressure vessel to be reinforced in both the hoop and the longitudinal direction. In addition, the present invention may provide a larger diameter cylindrical pressure vessel without the thicker walls of the end cap normally associated with such a larger diameter pressure vessel. An end fitting of the present invention may be comprised of a combination of a toroidal thin walled shell, for example made of steel, with a conventional end fitting in the center hole of the toroidal shell. The longitudinal forces from part of the toroidal shell and from the conventional end fitting may be transferred to the cylindrical wall of the pressure vessel by internal structural members.

Figure 1:
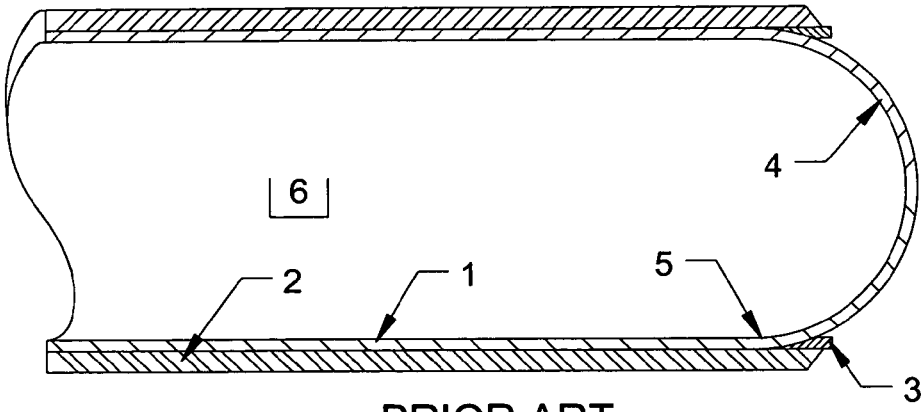
PRIOR ART Figure 1
FIG. 1 is longitudinal sectional view of one end of a prior art cylindrical pressure vessel reinforced on the exterior.

In contrast to the prior art, in which the diameter of high pressure gas tanks may be typically 36 or 40 inches, the diameter of pressure vessels using the end fitting of the present invention may be made of larger diameter in a practical manner, for example 3 meters or more. In contrast to the prior art, the end fitting of the present invention may allow the pressure vessel to be made lighter relative to its volume compared to the prior art pressure vessels. In contrast to the prior art, in which the components of the end fitting 4 (see FIG. 1) have conventional thicknesses, the thicknesses of the components of the end fitting 29 of the present invention may be reduced and may thereby be manufactured easily and inexpensively. In still further contrast to the prior art, in which expensive reinforced cut-outs may be required to be incorporated into the end fitting 4 (see FIG. 1) to allow an inspection into the pressure vessel, in the end fitting of the present invention, inspection of the interior of the pressure vessel may be accomplished by cutting center end fitting 23 at line 28, as seen in FIG. 2.

Figure 2:
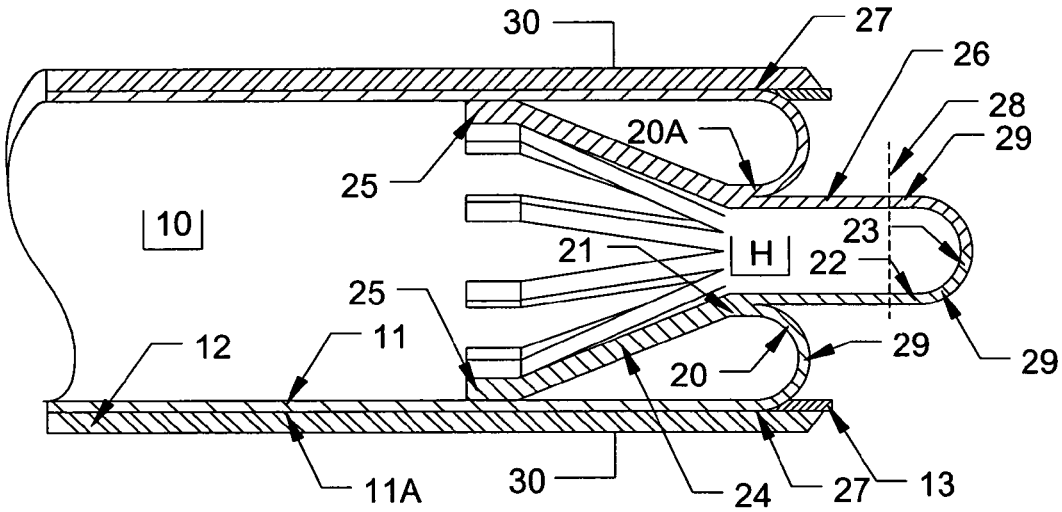
FIG. 2 is a longitudinal sectional view of one end of a cylindrical pressure vessel reinforced on the exterior and showing an end fitting of the present invention.

FIG. 2 shows a longitudinal section view of cylindrical pressure vessel 10 that is cut in a plane containing the rotational axis of symmetry of cylindrical pressure vessel 10. The pressure vessel 10 is comprised of a metal cylinder 11 reinforced on the exterior by a layer of reinforcement 12 that may be made from high strength metal wires (not shown) wound helically upon the cylinder 11. The reinforcing layer 12 is capable of reinforcing cylinder 11 both in the hoop direction and in the longitudinal direction. The reinforcing layer is terminated on the cylindrical extension 13 to cylinder 11 in order to be effective over the entire exterior surface of cylinder 11 that contains the pressure in pressure vessel 10.

Metal cylinder 11 of pressure vessel 10 is sometimes referred to herein as the outer cylindrical wall 11 of pressure vessel 10, whether or not metal cylinder 11 is reinforced by a reinforcement layer 12.

The end fitting 29 may be comprised of a toroidal shell 20 having hole H and a centrally disposed piece 26 covering or capping hole H in toroidal shell 20. Toroidal shell 20 may be said to have a central rim 20A. The centrally disposed piece 26 may include a pipe or pipes, for example pipes 21 and 22, and a center end fitting 23. Pipe 21 may be distinguished from pipe 22 in that pipe 21 may be contained within pressure vessel 10 and may have larger wall thicknesses than pipe 22. Although in FIG. 2, center end fitting 23 is hemispherical, center end fitting 23 may be other shapes including ellipsoidal.

As can be seen from FIG. 2 (as well as FIG. 4 and FIG. 6), toroidal shell 20 may be less than a complete toroidal shell and may be a partial toroidal shell. For example, as seen from FIG. 2 (as well as FIG. 4 and FIG. 6), toroidal shell 20 may contain the material of approximately 50% of a complete toroidal shell. As can be seen from FIG. 2 (as well as FIG.4 and FIG. 6), toroidal shell 20 may also include an outermost width 27 that may be attached to outer cylindrical wall 11 at the portion of outer cylindrical wall 11 adjacent toroidal shell 20. As can be seen from FIG. 2 (as well as FIG. 4 and FIG. 6), outer cylindrical wall 11 has an exterior width 11A.

Suppose that shell 11 is of a standard diameter such as 108 inches. Toroidal shell 20 may then be made from a standard 180 degree elbow (not shown) of a diameter of 36 inches cut in the plane of symmetry and then welded end to end. This weldment would have an outer diameter of 108 inches and a hole with a diameter of 36 inches. The hole H in the toroidal shell is then 36 inches permitting a standard 36 inch pipe 22 with a standard 36 inch center end fitting 23 to complete the end fitting 29. This center end fitting 23 to pipe 22 may be hemispherical (as shown) or ellipsoidal (not shown).

The internal pressure in pressure vessel 10 may exert a pressure on all the components of end fitting 29, the hemispherical center end fitting 23 and the toroidal shell 20. The hemispherical center end fitting 23 transmits the force through pipe 22 to pipe 21 inside pressure vessel 10. The toroidal shell 20 may be welded to pipe 21 and pipe 22 may be welded to pipe 21. Pipe 21 will normally not be of standard diameter because its outer diameter must be the outer diameter of pipe 22 plus two times the wall thickness of toroidal shell 20. The longitudinal force from the pressure on the inner ⅔ in terms of diameter of the end fitting 29 is transmitted to pipe 21, whereas the longitudinal force from the outer ⅓ in terms of diameter is transmitted directly into cylinder 11. Since the longitudinal force from the internal pressure is proportional to the projected areas it may be concluded that $(2/3)^2=4/9$ of the total longitudinal force is transmitted to pipe 21 and $(1-(2/3)^2)=5/9$ directly to cylinder 11.

As shown in FIG. 2 the longitudinal force in pipe 21 comprising 4/9 of the total longitudinal force from the end fitting 29 is transmitted to cylinder 11 by pipe 21 being sliced longitudinally in a number of slices 24 that may be bent out toward the cylinder 11 and that may then be welded to the inside of cylinder 11 through the use of sections 25 that may be parallel to the surface of cylinder 11. By this means the total longitudinal force from end fitting 29 is transmitted to the cylindrical pressure vessel structure comprising cylinder 11 and reinforcing layer 12. Sections 25 may be thought of as extensions of and forming a part of cylinder 11 and/or of internal structural members 24.

Assume that cylinder 11 and toroidal shell 20 are made from the same strength material. In this case cylinder 11 may be designed to carry only ⅓ of the hoop force and reinforcing layer 12 ⅔ of the hoop force. This will make pressure vessel 11 lighter than a comparable prior art pressure vessel (for example FIG. 1). A proper lay angle of the wires (not shown) comprising layer 12 will then ensure force balance in the longitudinal direction as well.

Alternatively, instead of structural members 24 extending from pipe 21, structural members 24 may extend from and may be welded to a rim of toroidal shell 20. Structural members 24 may then be extended to and may be welded to the inside of cylinder 11.

Figure 3:
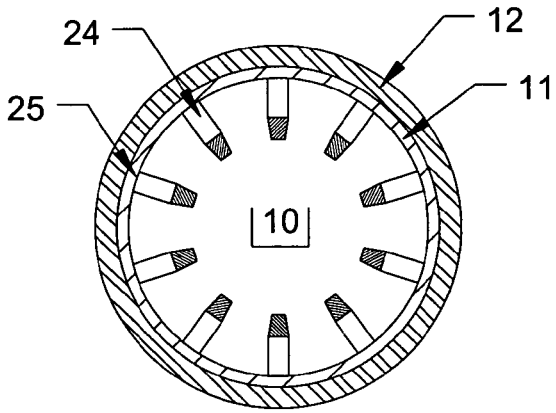
FIG. 3 is a sectional view of the pressure vessel shown in FIG. 2 cut through an area showing the structural members that transmit longitudinal forces from an end fitting of the present invention to the metal cylinder of the pressure vessel.

FIG. 3 shows a section 30-30 of pressure vessel 10 shown in FIG. 2. The section 30-30 shows the cylinder 11 and the reinforcing layer 12. Section 30-30 cuts through the slices 24 of pipe 21 and shows the end of sections 25 that are welded to cylinder 11.

Figure 4:
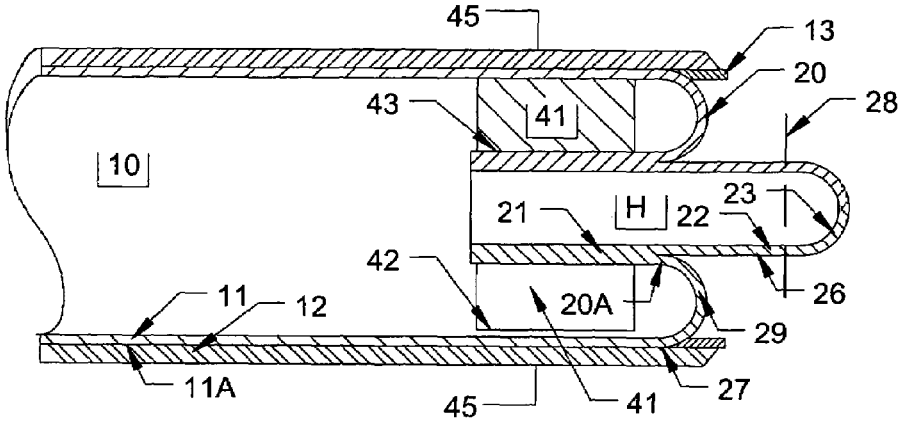
FIG. 4 is a longitudinal sectional view of one end of a cylindrical pressure vessel reinforced on the exterior and showing a second embodiment of the end fitting of the present invention.

FIG. 4 shows a section in a plane containing the rotational axis of symmetry of a cylindrical pressure vessel 10 similar to the pressure vessel 10 shown in FIG. 2 except a separate embodiment is shown for the transfer of the longitudinal forces from end fitting 29 to the cylinder 11.

In this embodiment centrally disposed piece 26, and in particular pipe 21 of centrally disposed piece 26 may be extended further through the pressure vessel 10 than in FIG. 2, and the longitudinal force transmitted through pipe 21 may be transmitted as shear through plates 41 and welds 42, 43 to cylinder 11. In all other respects this embodiment may be identical to the embodiment shown in FIG. 2.

In all three embodiments, when the cylinder 11 is not reinforced (and as to the first two embodiments even in some cases when the cylinder 11 is reinforced) the wall thicknesses of the toroidal shell 20 and the center end fitting 23 may be less than, and may be considerably less than, a thickness of the outer cylindrical wall 11 of the pressure vessel 10. For example, where hole H is roughly one-third the width of the diameter of cylinder 11, the thickness of toroidal shell 20 and of center end fitting 23 may be about one-third that of outer cylindrical wall 11. Purely as an example, where hole H is increased or decreased from one-third the width of the diameter of cylinder 11, the thickness of the toroidal shell 20 or the center end fitting 23 may decrease to less than roughly one-third or may increase to, for example, roughly one-half the thickness of the outer cylindrical wall 11.

Although welds 42, 43 have been described as separate from plates 41 and from outer cylindrical wall 11, welds 42, 43 may also be thought of as extensions of plates 41 and/or cylinder 11 and therefore forming a portion thereof.

Figure 5:
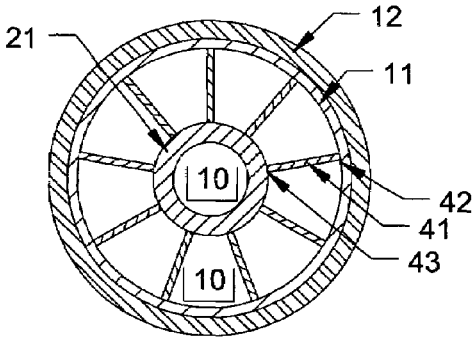
FIG. 5 is a sectional view of the pressure vessel shown in FIG. 4 cut through an area showing the structural members that transmit longitudinal forces from the end fitting of FIG. 4 to the metal cylinder of the pressure vessel.

FIG. 5 shows a section 45-45 of pressure vessel 10 shown in FIG. 4. The section 45-45 shows the cylinder 11 and the reinforcing layer 12. Section 45-45 cuts through the plates 41 and shows 9 such plates 41. However the number of shear plates will depend on the detailed design of pressure vessel 10 and may vary considerably from what is shown in this figure. Plates 41 may be welded to pipe 21 at weld 43 and to cylinder 11 at weld 42.

Figure 6:
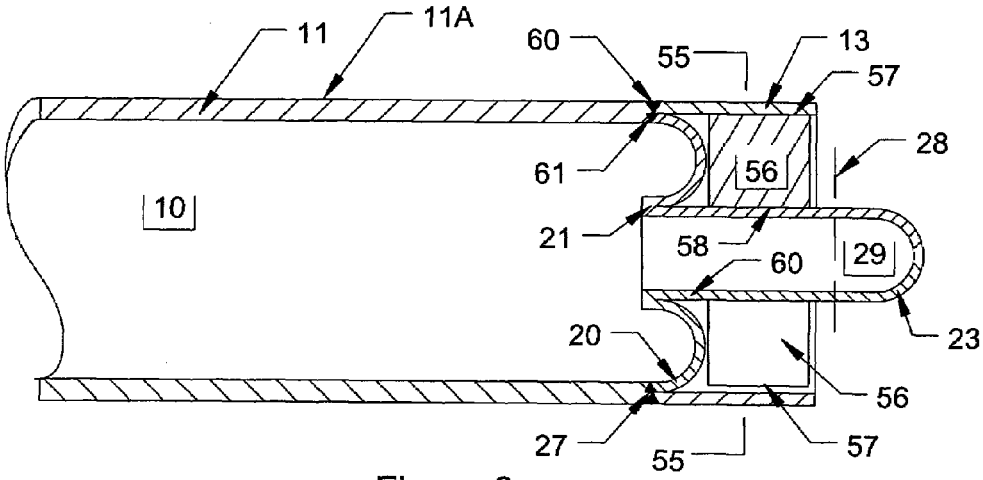
FIG. 6 is a longitudinal sectional view of one end of a cylindrical pressure vessel unreinforced on the exterior and showing a third embodiment of the end fitting of the present invention.

FIG. 6 shows a section in a plane containing the rotational axis of symmetry of a cylindrical pressure vessel 10 that is not reinforced on the exterior. FIG. 6 also shows a third embodiment of end fitting 29 for the transfer of longitudinal forces from end fitting 29 to the cylindrical shell 11. The cylindrical shell 11 must in this case be designed for the full hoop stress, which is twice the longitudinal stress. The toroidal shell 20 in accordance with this invention may be made to exert a stress on the end of cylinder 11, which is only 40 to 60% of the longitudinal stress in cylinder 11, and be of a wall thickness of only about ⅓ of the cylinder 11. The application of embodiments one (see FIGS. 2-3) or two (see FIGS. 4-5) would in this case cause a large change in wall thickness between end fitting 29 and cylinder 11 causing stress concentrations at the joint between cylinder 11 and end fitting 29. The end fitting 29 in this third embodiment may include an extension 13 to cylinder 11 beyond the toroidal shell that may be similar to the extensions 13 shown in FIG. 2 and FIG. 4. However in this embodiment the extension 13 of the outer cylindrical wall 11 may provide a means to transmit part of the longitudinal forces acting on end fitting 29 to cylinder 11. By proportioning the wall thicknesses of cylindrical extension 13 and toroidal shell 20 to the diameters of toroidal shell 20 and hemispherical center end fitting 23, the longitudinal stress in cylinder extension 13 and the stress in toroidal shell 20 may be made approximately equal to the longitudinal stress in cylinder 11.

FIG. 6 shows the toroidal shell 20 welded to cylinder 11 by weld 61 and the cylinder extension 13 welded to cylinder 11 by weld 60. Thus the end fitting 29 may be fitted to pressure vessel 10 by successively welding the various components onto pressure vessel 10. Alternatively end fitting 29 may be manufactured and completed before being joined to pressure vessel by combining the welds 61 and 60 in a single circumferential weld. Although welds 60, 61 have been described separately, they may also be thought of as extensions of that which they are welded to and forming a portion thereof.

In this embodiment (see FIGS. 6-7), part of the longitudinal force transmitted through pipe 21 and 60 is transmitted as shear through plates 56 and welds 57 and 58 to outer cylindrical wall extension 13. In this embodiment the structural members are outside the pressure vessel and therefore more accessible for inspection. It is the intention of FIG. 6 to show that plates 56 need not make contact with toroidal shell 20.

Figure 7:
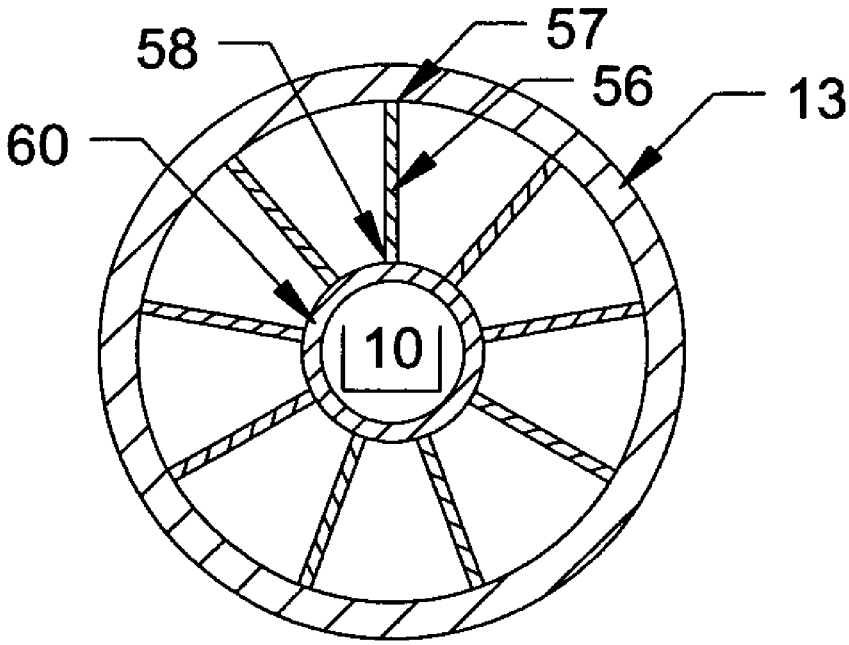
FIG. 7 is a sectional view of the pressure vessel shown in FIG. 6 showing the structural members transmitting the longitudinal forces from the end fitting to the metal cylinder of the pressure vessel.

FIG. 7 shows a section 55-55 of pressure vessel 10 shown in FIG. 6. The section 55-55 shows the cylinder extension 13. Section 55-55 cuts through the plates 56 and shows 9 such plates 56. However the number of shear plates will depend on the detailed design of pressure vessel 10 and may vary considerably from what is shown in this figure. Plates 56 are welded to pipe 60 at weld 58 and to cylinder extension 13 at weld 57.

The present invention can also be characterized as a pressure vessel, comprising a generally cylindrical metal container, a first end cap; and a second end cap, where at least one of the first and second end caps comprise a toroidal shell defining a hole; a centrally disposed piece closing the hole and comprising a pipe and a center end fitting; and structural members that connect either the toroidal shell or the centrally disposed piece to either the outer cylindrical wall or to an extension of the outer cylindrical wall.

It should be understood, of course, that the foregoing relates to exemplary embodiments of the invention and that modifications may be made without departing from the spirit and scope of the invention as set forth in the following claims.

I claim:

1. An end fitting for a cylindrical pressure vessel, the end fitting integrally joined to the pressure vessel, the pressure vessel having an outer cylindrical wall, the end fitting comprising:

a partial toroidal shell defining a hole, and including an outermost width that is attached to the outer cylindrical wall;

a centrally disposed piece comprising a pipe and a center end fitting, the centrally disposed piece closing the hole; and structural members that connect either the centrally disposed piece and/or the toroidal shell to the outer cylindrical wall or to an extension of the outer cylindrical wall, wherein the end fitting is structured so that a fraction of the longitudinal forces from internal pressure is transmitted to the outer cylindrical wall or the extension by means of the structural members and a remainder of the longitudinal forces from the internal pressure is transmitted directly to the outer cylindrical wall.

2. The end fitting of claim 1, wherein the structural members are internal structural members that connect either part of the toroidal shell and/or the cylindrical extension of the toroidal shell to the outer cylindrical wall.

3. The end fitting of claim 1, wherein the structural members are external structural members that connect the centrally disposed piece to an extension of the outer cylindrical wall.

4. The end fitting of claim 1, wherein the center end fitting is ellipsoidal.

5. The end fitting of claim 1, wherein the center end fitting is hemispherical.

6. An end fitting for a cylindrical pressure vessel, the end fitting integrally joined to the pressure vessel, the pressure vessel having an outer cylindrical wall, the end fitting comprising:

a partial toroidal shell including a central rim that defines a hole inward of the central rim, and including an outermost width of the toroidal shell that is attached to the outer cylindrical wall;

a centrally disposed piece closing the hole; and a series of internal structural members extending from the toroidal shell or from the centrally disposed piece to the outer cylindrical wall, wherein the end fitting is structured so that a fraction of the longitudinal forces from internal pressure is transmitted to the outer cylindrical wall by means of the structural members and a remainder of the longitudinal forces from the internal pressure is transmitted directly to the outer cylindrical wall.

7. The end fitting of claim 6, wherein the internal structural members are segmented.

8. The end fitting of claim 6, wherein the internal structural members extend from an area of the central rim to the outer cylindrical wall.

9. The end fitting of claim 6, wherein the centrally disposed piece includes a pipe and a center end fitting and the internal structural members extend from the pipe to the outer cylindrical wall.

10. An end fitting for a cylindrical pressure vessel, the end fitting integrally joined to the pressure vessel, the pressure vessel having an outer cylindrical wall, the end fitting comprising:

a partial toroidal shell including a central rim that defines a hole inward of the central rim, and including an outermost width of the toroidal shell that is attached to the outer cylindrical wall;

a centrally disposed piece closing the hole, the centrally disposed piece comprising a pipe and a center end fitting; and a series of plates connecting the pipe to the outer cylindrical wall, wherein the end fitting is structured so that a fraction of the longitudinal forces from internal pressure is transmitted to the outer cylindrical wall by means of the plates and a remainder of the longitudinal forces from the internal pressure is transmitted directly to the outer cylindrical wall.

11. The end fitting of claim 10, wherein wall thicknesses of the toroidal shell and the center end fitting are less than a thickness of the outer cylindrical wall of the pressure vessel.

12. The end fitting of claim 10, wherein the pipe runs generally parallel to the outer cylindrical wall of the pressure vessel.

13. An end fitting for a cylindrical pressure vessel; the end fitting integrally joined to the pressure vessel, the pressure vessel having an outer cylindrical wall, the end fitting comprising:

a partial toroidal shell defining a hole and including an outermost width that is attached to the outer cylindrical wall;

an extension of the outer cylindrical wall beyond the toroidal shell;

a centrally disposed piece comprising a pipe and a center end fitting, the centrally disposed piece closing the hole; and a series of structural members connecting the centrally disposed piece and the extension of the outer cylindrical wall, wherein the end fitting is structured so that a fraction of the longitudinal forces from internal pressure is transmitted to the extension of the outer cylindrical wall by means of the structural members and a remainder of the longitudinal forces from the internal pressure is transmitted directly to the outer cylindrical wall.

14. The end fitting of claim 13, wherein the structural members connect the pipe to the extension of the outer cylindrical wall.

15. The end fitting of claim 13, wherein a wall thickness of the toroidal shell is less than a thickness of the outer cylindrical wall of the pressure vessel.

16. A pressure vessel, comprising:

a generally cylindrical metal container, a first end cap; and a second end cap, at least one of the first and second end caps integrally joined to the pressure vessel and comprising:

a partial toroidal shell defining a hole and including an outermost width that is attached to the outer cylindrical wall of the container;

a centrally disposed piece closing the hole and comprising a pipe and a center end fitting; and structural members that connect the toroidal shell and/or the centrally disposed piece to either the outer cylindrical wall or to an extension of the outer cylindrical wall, wherein the end fitting is structured so that a fraction of the longitudinal forces from internal pressure is transmitted to the outer cylindrical wall or the extension by means of the structural members and a remainder of the longitudinal forces from the internal pressure is transmitted directly to the outer cylindrical wall.

17. The pressure vessel of claim 16, wherein both the first end cap and the second end cap comprise a toroidal shell, a centrally disposed piece and structural members that connect either the toroidal shell or the centrally disposed piece to the outer cylindrical wall or to the extension of the outer cylindrical wall.

18. The pressure vessel of claim 16, wherein the center end fitting is ellipsoidal.

19. The pressure vessel of claim 16, wherein the center end fitting is hemispherical.

20. The end fitting of claim 1, wherein the outermost width of the toroidal shell is narrower or equal to an exterior width of the outer cylindrical wall at a portion of the outer cylindrical wall adjacent the toroidal shell.

21. The end fitting of claim 6, wherein the outermost width of the toroidal shell is narrower or equal to an exterior width of the outer cylindrical wall at a portion of the outer cylindrical wall adjacent the toroidal shell.

22. The end fitting of claim 10, wherein the outermost width of the toroidal shell is narrower or equal to an exterior width of the outer cylindrical wall at a portion of the outer cylindrical wall adjacent the toroidal shell.

23. The end fitting of claim 13, wherein the outermost width of the toroidal shell is narrower or equal to an exterior width of the outer cylindrical wall at a portion of the outer cylindrical wall adjacent the toroidal shell.

24. The end fitting of claim 16, wherein the outermost width of the toroidal shell is narrower or equal to an exterior width of the outer cylindrical wall at a portion of the outer cylindrical wall adjacent the toroidal shell.

25. The end fitting of claim 13, wherein the structural members are plates.

26. The end fitting of claim 1, wherein the structural members are connected to the outer cylindrical wall by welding.

27. The end fitting of claim 6, wherein the internal structural members are welded to the outer cylindrical wall.

28. The end fitting of claim 10, wherein the plates are welded to the outer cylindrical wall.

29. The end fitting of claim 13, wherein the structural members are welded to the extension of the outer cylindrical wall.

30. The end fitting of claim 16, wherein the structural members are connected to the outer cylindrical wall by welding.

31. The end fitting of claim 1, wherein the pressure vessel is capable of storing gas under high pressure of at least 8 Mpa.

32. The end fitting of claim 6, wherein the pressure vessel is capable of storing gas under high pressure of at least 8 Mpa.

33. The end fitting of claim 10, wherein the pressure vessel is capable of storing gas under high pressure of at least 8 Mpa.

34. The end fitting of claim 13, wherein the pressure vessel is capable of storing gas under high pressure of at least 8 Mpa.

35. The end fitting of claim 16, wherein the pressure vessel is capable of storing gas under high pressure of at least 8 Mpa.

* * * * *